United States Patent [19]

Sando et al.

[11] Patent Number: 4,528,708

[45] Date of Patent: Jul. 16, 1985

[54] METHOD FOR CONTINUOUS WET-HEAT TREATMENT OF A CLOTH

[75] Inventors: Yoshikazu Sando; Hiroshi Ishidoshiro, both of Wakayama, Japan

[73] Assignee: Sando Iron Works Co., Ltd., Tokyo, Japan

[21] Appl. No.: 543,263

[22] Filed: Oct. 19, 1983

[30] Foreign Application Priority Data

Oct. 20, 1982 [JP] Japan ..... 57-183884
Oct. 20, 1982 [JP] Japan ..... 57-183885

[51] Int. Cl.[3] ..... D06B 3/12

[52] U.S. Cl. ..... 8/149.1; 8/149.3; 68/50; 68/200

[58] Field of Search ..... 68/5 D, 5 E, 200, 202; 8/149.1, 149.3

[56] References Cited

U.S. PATENT DOCUMENTS

| | | | |
|---|---|---|---|
| 1,663,846 | 3/1928 | Jacoby | 68/5 D |
| 2,441,991 | 5/1948 | Converse et al. | 68/5 E |
| 3,181,967 | 5/1965 | Amos et al. | 68/200 X |
| 3,367,039 | 2/1968 | Jacobsen | 68/5 D X |

FOREIGN PATENT DOCUMENTS

| | | | |
|---|---|---|---|
| 2823688 | 12/1978 | Fed. Rep. of Germany | 68/5 E |
| 480122 | 2/1938 | United Kingdom | 68/202 |

*Primary Examiner*—Philip R. Coe
*Attorney, Agent, or Firm*—Toren, McGeady, Stanger, Goldberg & Kiel

[57] ABSTRACT

A method for continuous wet-heat treatment of a cloth comprising transporting a cloth continuously through a wet-heat treatment chamber under the ordinary pressure heating the cloth with the use of a heating fluid passing through a plurality of heating pipes provided closely along the cloth passage while applying to the cloth a high temperature treating liquid oozed or squeezed out of a plurality of liquid apply pipes in contact with the cloth; and an apparatus therefor.

1 Claim, 2 Drawing Figures

METHOD FOR CONTINUOUS WET-HEAT TREATMENT OF A CLOTH

BACKGROUND OF THE INVENTION

1. Field of the Invention

The present invention relates to a method for continuous wet-heat treatment of a long cloth in which a high temperature treating liquid above 100° C. is applied to the cloth in a wet-heat treatment chamber under the ordinary or normal atmospheric pressure for obtaining an excellent quality of treated cloth continuously and speedily.

2. Description of the Prior Art

Conventional methods for subjecting a long cloth to such treatments as scouring, bleaching, dyeing, resin finish and weight reduction continuously may be classified into an ordinary pressure treating method, which is done under the ordinary or normal atmospheric pressure, and a high pressure treating method, which is done under high pressure above normal atmospheric pressure, but the former ordinary pressure method needs a long time until the treatment is completed, lacking mass productivity, and is inferior in the quality of the product. Under such circumstances, the latter high pressure method, which is excellent in its rapidity in the treatment and superior in the quality of the product, is widely adopted at the present time. The high pressure treating method is to use a high pressure steamer or a reactor, which is able to pass a cloth continuously therethrough while maintaining the interior thereof with a high temperature and humidity atmosphere, for continuous wet-heat treatment of a cloth. By the heat treatment under a high temperature and humidity atmosphere, the treating liquid reacts easily with the cloth, and such treatments as scouring, bleaching, dyeing, resin finish and weight reduction in object can be done continuously and speedily.

In such a high pressure wet-heat treating method of a cloth continuously, however, it is necessary to maintain the interior of the steamer body with a high temperature and humidity atmosphere prior to the wet-heat of a cloth, so that it needs a long time until the interior of the steamer body reaches to a sufficiently high temperature and humidity condition, thus prolonging the preparatory time and consuming a large heat energy. Further, in providing seal mechanisms at the cloth inlet and outlet of the steamer body for allowing the taking in and out of a cloth continuously while maintaining the interior of the steamer body with a high temperature wet-heat, the whole structure of the steamer body becomes complicated, and particularly a large size apparatus becomes very costly from the standpoints of the pressure- and heat resisting structure.

The present applicants have recently proposed a hot liquid treatment chamber of a cloth at the ordinary pressure, in which a plurality of nozzles are provided in adjacent to both sides of the cloth passing continuously therethrough for jetting high temperature treating liquid to the cloth, for the wet-heat of a cloth in object. The construction of the apparatus is simple, but the high temperature treating liquid (vapor) jetted from a plurality of nozzles flows by convection in such a hot liquid treatment chamber, and consequently, the action of wet-heat becomes uneven in the width direction of the cloth, causing unevenness in the treatment, particularly dye speck in dyeing.

SUMMARY OF THE INVENTION

The present invention is done under such circumstances, and the object of the invention is to offer a method for continuous wet-heat treatment of a cloth under the ordinary pressure.

The principle of the inventive method comprises transporting a cloth to be treated continuously through a wet-heat treatment chamber under the ordinary pressure that is, normal atmospheric pressure, while heating the cloth up to a temperature, for instance, as high as nearly 300° C. with the use of a heating fluid passing through a plurality of heating pipes provided closely along the cloth and applying a high temperature treating liquid oozed or squeezed out of a plurality of liquid apply pipes to the cloth.

A cloth can be wet-heat treated uniformly to give an uniform and excellent product with the use of a simplified apparatus and by sparing water resources and heat energy economically.

DETAILED DESCRIPTION OF THE INVENTION

The present invention will be explained in detail in the following with reference to the drawings showing the examples of the inventive apparatus.

Figure 1:
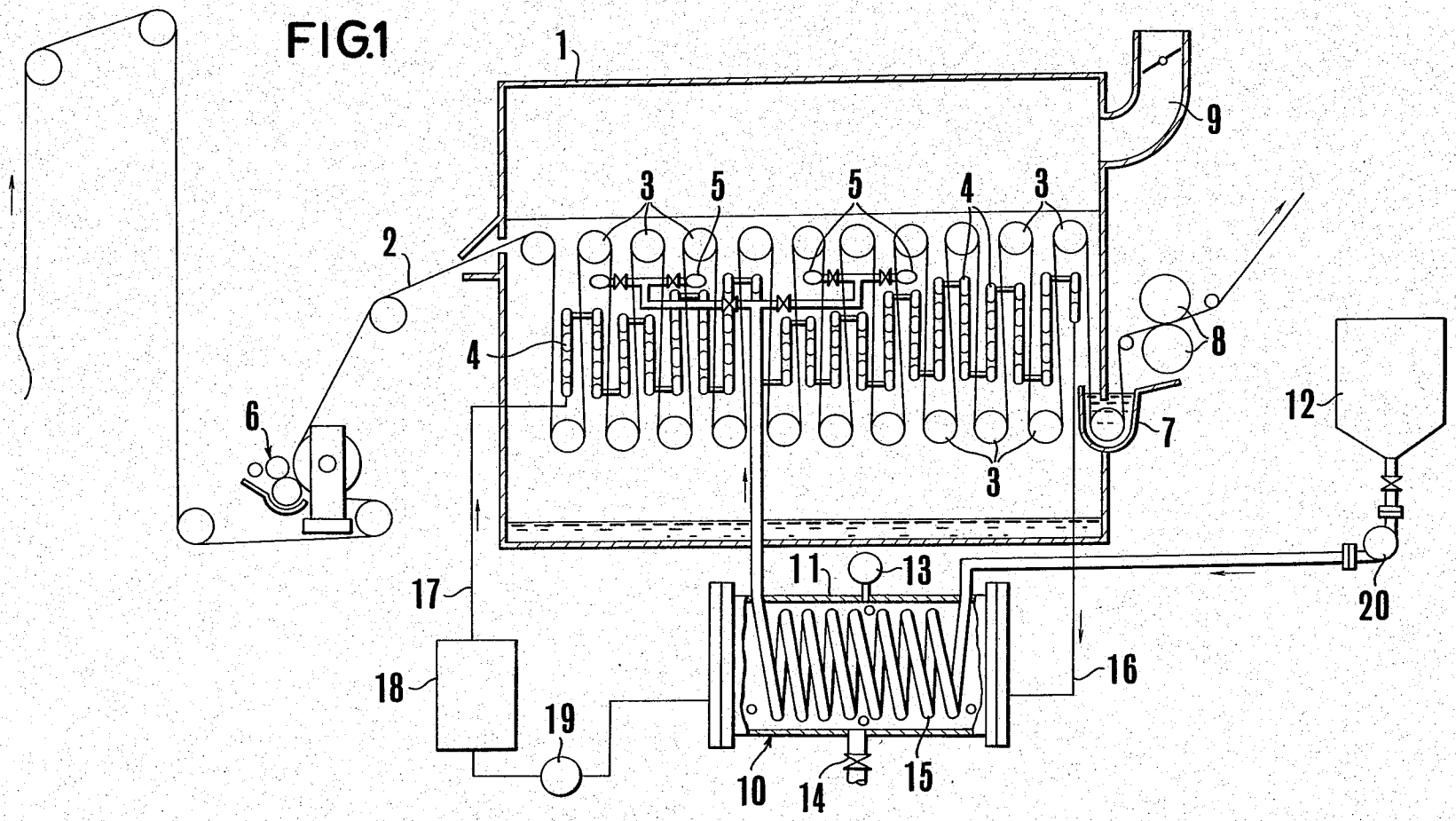
FIG. 1 is an explanatory drawing showing the construction of an example of the present inventive apparatus for continuous wet-heat treatment of a cloth.

In FIG. 1, 1 is a wet-heat treatment chamber under the ordinary pressure for continuous wet-heat treatment of a long cloth to be treated 2. 3 are a plurality of cloth guide rollers provided up and down in two stages in the wet-heat treatment chamber 1 for transporting the cloth 2 zigzag forming snaky undulations under no tension through the chamber 1. It is preferable to substitute all or a part of the upper stage guide rollers with open width rollers for preventing the formation of creases of the cloth. 4 are a plurality of heating pipes provided in series closely along the passage of the cloth 2 transported forming snaky undulations by means of the guide rollers 3. It is so designed that a high boiling point oil as a heating fluid at a temperature as high as 300° C. coming from the boiler 18 as will be mentioned hereinafter is passed through the heating pipes 4. 5 are a plurality of treating liquid apply pipes in contact with the cloth for soaking the cloth 2 with a prescribed high temperature treating liquid (a treating solution or water). The treating liquid apply pipes 5 are designed so that a necessary amount of high temperature treating liquid above 100° C. coming out of the treating liquid heater 10 as will be mentioned hereinafter is oozed or squeezed out successively for applying the treating liquid to the cloth. 6 is a treating solution apply device provided at the front part outside of the wet-heat treatment chamber 1 for applying a definite amount of a treating solution (such as a scouring solution, bleaching solution, dye solution and resin solution) successively and uniformly to a cloth to be treated 2. 7 is a liquid seal tank provided at the outlet of the wet-heat treatment chamber 1, 8 is a squeeze roller and 9 is an exhaust duct.

10 is a treating liquid heater provided outside of the wet-heat treatment chamber 1. The treating liquid heater 10 comprises a sealable body 11, an inner pressure automatic control valve 13 for maintaining the inner pressure of the body 11 constant, and a heating fluid discharge valve 14 to be used in the case of need. 15 is a treating liquid heating pipe provided zigzag forming snaky undulations in the body 11. The treating liquid heating pipe 15 is communicating to a treating liquid tank 12 provided outside of the body 11 and to the treating liquid apply pipes 5 in the wet-heat treatment chamber 1 for heating the treating liquid prior to the application of the treating liquid to the cloth. The construction of the heating pipe 15 is optional. It is advisable to form the pipe so that the heat in the body 11 can easily be received or, particularly, a plurality of wings are attached to the pipe for increasing heat conductivity. 16 is a conduit communicating one end of the heating pipes 4 in the wet-heat treatment chamber 1 and the body 11 of the treating liquid heater 10, and 17 is a conduit communicating the other end of said heating pipes 4 and the body 11 by putting a boiler 18 for heating the heating fluid passing through the pipe 17 therebetween. 19 and 20 are pumps for sending the liquids under pressure.

Wet-heat treatment of a cloth by using the apparatus in this example will now be described in the following.

At first, the cloth guide rollers 3 and the treating liquid apply divice 6 are driven for transporting a cloth 2 soaked with a prescribed treating liquid by means of the treating liquid apply device 6 through the wet-heat treatment chamber 1. Simultaneously the boiler 18 is heated for heating the oil as a heating fluid in the conduit 17 to a temperature about 300° C., and the heated oil is passed into the heating pipes 4 in the wet-heat treatment chamber 1 for heating the pipes 4. In this way, the cloth 2, which is running near the heating pipes 4 through the wet-heat treatment chamber 1, is heated up to a temperature, for instance, nearly 250° C. for the wet-heat treatment of the cloth. The heating oil flowing through the heating pipes 4 lowers its temperature gradually by giving heat to the heating pipes. In this example, the temperature of the heating oil is lowered to nearly 200° C. at the end portion of the heating pipes 4. The oil is circulated to the body 11 of the liquid heater 10 by means of the conduit 16 and then passed into the boiler 18, where it is heated again to nearly 300° C., and circulated through the conduit 17 into the heating pipes 4.

In the body 11 of the liquid heater 10, the treating liquid supplied from the liquid tank 12 into the treating liquid heating pipe 15 is heated up to nearly 200° C. with the use of the heating oil in the body 11. The heated treating liquid is then applied to the cloth by means of the treating liquid apply pipes 5. Since the treating liquid apply pipes 5 are designed so that a limited amount of the treating liquid is oozed or squeezed out uniformly and continuously, a necessary and sufficient amount of the treating liquid is applied to the cloth effectively.

Figure 2:
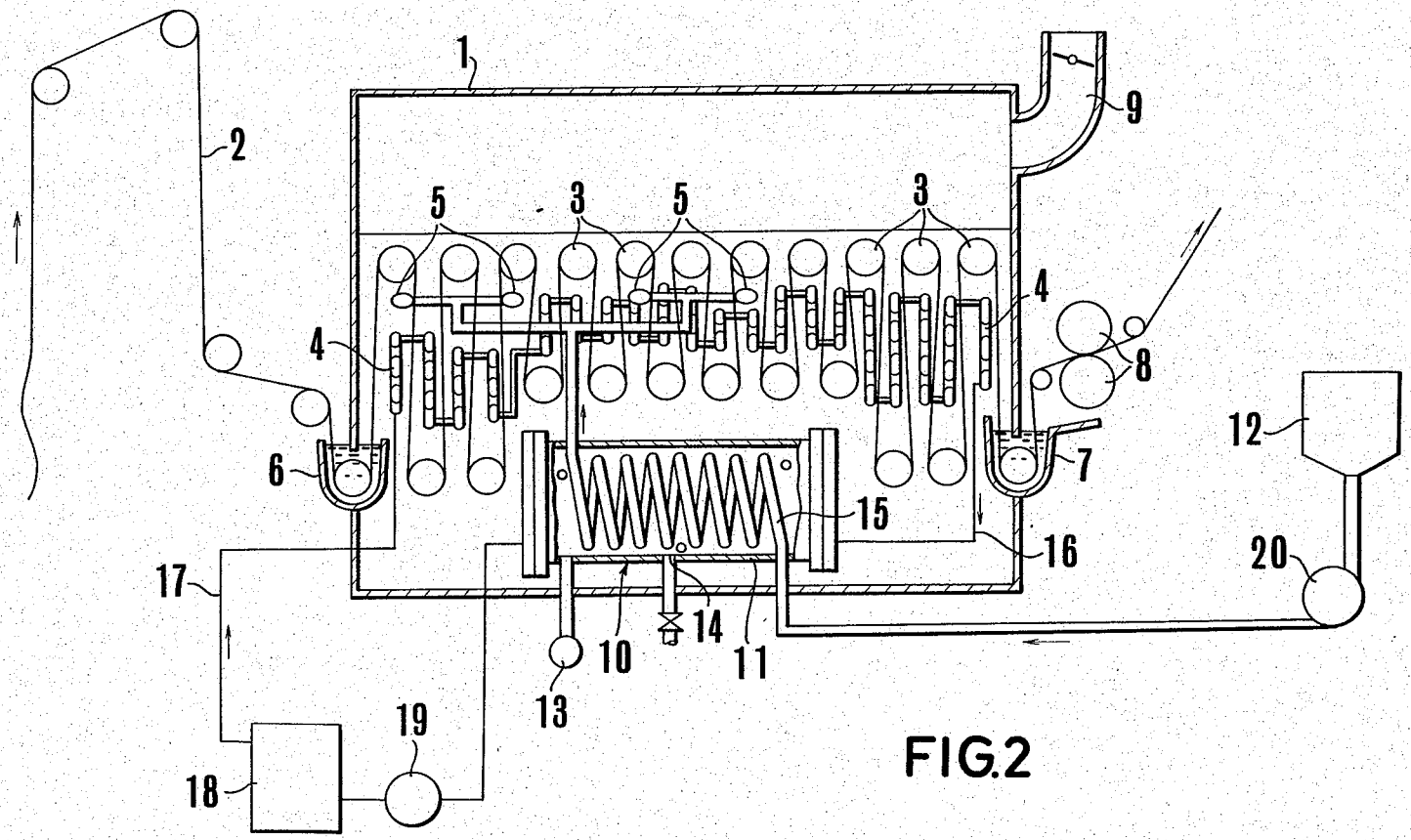
FIG. 2 shows a modification of the apparatus in FIG. 1.

FIG. 2 shows a modification of the inventive apparatus shown in FIG. 1. In this example, the treating liquid apply device 6 is provided at the inlet of the wet-heat treatment chamber 1, and the treating liquid heater 10 is provided in the wet-heat treatment chamber. Other constructions of the apparatus are the same as those of the apparatus shown in FIG. 1. The treating liquid apply device 6 serves simultaneously as a liquid seal tank at the inlet of the wet-heat treatment chamber 1. In this example, particularly, since the treating liquid heater is provided inside of the wet-heat treatment chamber 1 whose temperature is, for instance, as high as 150° to 180° C., the heat radiation from the liquid heater 10 can effectively and economically be prevented.

As described in the above, the present invention is to transport a cloth continuously through a wet-heat treatment chamber under the ordinary pressure by heating the cloth with the use of a heating fluid passing through a plurality of heating pipes provided closely along the cloth while applying a high temperature treating liquid oozed or squeezed out of a plurality of liquid apply pipes to the cloth. Therefore, a cloth can be wet-heat treated at a temperature in the range about 200° to 250° C. under the ordinary pressure. A sufficient amount of the treating liquid and heat can be applied to the cloth, and a treated cloth with an excellent quality can be mass produced. Further, since the cloth is heated with the use of radiation heat from the heating pipes without applying convection heat, the heat treatment can be done uniformly all over the cloth to give a cloth of equal quality. In this way, the present invention is excellent in minimization of the use of treating liquid, saving of water resource and heat energy, and the apparatus is simplified.

What we claim:

1. A method for continuous wet-heat treatment of a cloth, comprising transporting the cloth along a zig-zag up and down undulating path of travel through a wet-heat treatment chamber from an inlet into the chamber to an outlet from the chamber with the interior of the chamber under normal atmospheric pressure, heating the cloth in indirect heat transfer relation with the use of a high boiling point heating fluid as the heat source at a temperature as high as 300° C. and passing through a plurality of heat pipes provided closely adjacent the cloth along the path of travel of the cloth between the inlet and outlet, and, as the cloth passes between the inlet and outlet applying directly to the cloth a high temperature heating liquid at a temperature above 100° C. oozed or squeezed out of a plurality of liquid apply pipes in direct contact with the cloth.

* * * * *